US005242368A

United States Patent [19]

Buckley et al.

[11] Patent Number: 5,242,368

[45] Date of Patent: Sep. 7, 1993

[54] CROSS FOLDER TRANSPORT

[75] Inventors: Franklin J. Buckley, Bethel; Earl E. Eschweiler, Jr., Norwalk; Susan Mahmoodi, Southbury; Joseph H. Marzullo, Brookfield; Harold L. Taylor, New Milford; Walter Wolog, Orange, all of Conn.

[73] Assignee: Pitney Bowes Inc., Stamford, Conn.

[21] Appl. No.: 910,813

[22] Filed: Jul. 9, 1992

[51] Int. Cl.[5] ..... B65H 45/14

[52] U.S. Cl. ..... 493/421; 493/458

[58] Field of Search ..... 493/417, 420, 421, 424, 493/458, 435, 442, 445, 444; 271/224

[56] References Cited

U.S. PATENT DOCUMENTS

| | | | |
|---|---|---|---|
| 1,831,246 | 11/1931 | Hitchcock | 493/421 |
| 3,901,501 | 8/1975 | Kistner | 493/444 |
| 4,314,644 | 2/1982 | Stocker . | |
| 4,676,497 | 6/1987 | Selak . | |
| 4,840,609 | 6/1989 | Jones | 493/444 |
| 4,981,400 | 1/1991 | Stover . | |
| 4,995,858 | 2/1991 | Stab . | |
| 5,061,146 | 10/1991 | Nelson | 271/224 |

*Primary Examiner*—Bruce M. Kisliuk
*Assistant Examiner*—Jack Lavinder
*Attorney, Agent, or Firm*—Charles R. Malandra, Jr.; Melvin J. Scolnick

[57] ABSTRACT

Apparatus for cross-folding paper sheets, including: a first folding device for imparting a first fold to a paper sheet; a transport module secured to the first folding device for receiving a once folded paper sheet, and a second folding device oriented perpendicular to the first folding device and secured to the transport module, wherein the transport module includes a pivotable paper stop assembly having a self-centering stopping surface to stop and align the once folded paper sheet and a brush for controlling bounceback of the once folded paper sheet.

9 Claims, 5 Drawing Sheets

48
46
60
62
66
50
88
70
76
58
90
78
56
74
82
64
84
86
68
73
42
42

CROSS FOLDER TRANSPORT

BACKGROUND OF THE INVENTION

The instant invention relates to paper folding apparatus, and more particularly to a transport device used with apparatus for imparting perpendicular folds to paper.

It is well known to fold paper sheets using buckle chute folders to impart one or more folds. In some operations it is desirable to impart two folds perpendicular to each other. Such operations typically employ identical folders oriented perpendicular to each other and change the direction of travel of the document being folded so that after it is folded in one direction, its path of travel is changed to become perpendicular to the original path of travel whereupon the folded document enters a second folder and is folded along a line perpendicular to the original fold line. Such a combination of folding is referred to in the art as cross folding.

Once the document is ready to have its direction of travel changed, it is necessary to slow the document, stop the document, and align the document for subsequent folding. Such processes require time and space in the architecture of the folding apparatus, as a result of which cross folding is known to be effected only in large, console folding and inserting systems and is not used in table-top inserting systems. The instant invention minimizes the amount of time and space necessary to effect the change of travel direction of the document being cross folded, and provides a cross folder transport module which is small enough that it can be used in a table-top inserting system.

SUMMARY OF THE INVENTION

Accordingly, the instant invention provides apparatus for cross-folding paper sheets. The apparatus comprises: a first folding device for imparting a first fold to a paper sheet; a transport module secured to said first folding device for receiving said once folded paper sheet; and a second folding device oriented perpendicular to said first folding device and secured to said transport module, wherein said transport module includes a pivotable paper stop assembly having a self-centering stopping surface to stop and align said once folded paper sheet and a brush for controlling bounceback of said once folded paper sheet.

DETAILED DESCRIPTION OF THE PREFERRED EMBODIMENT

Figure 6:
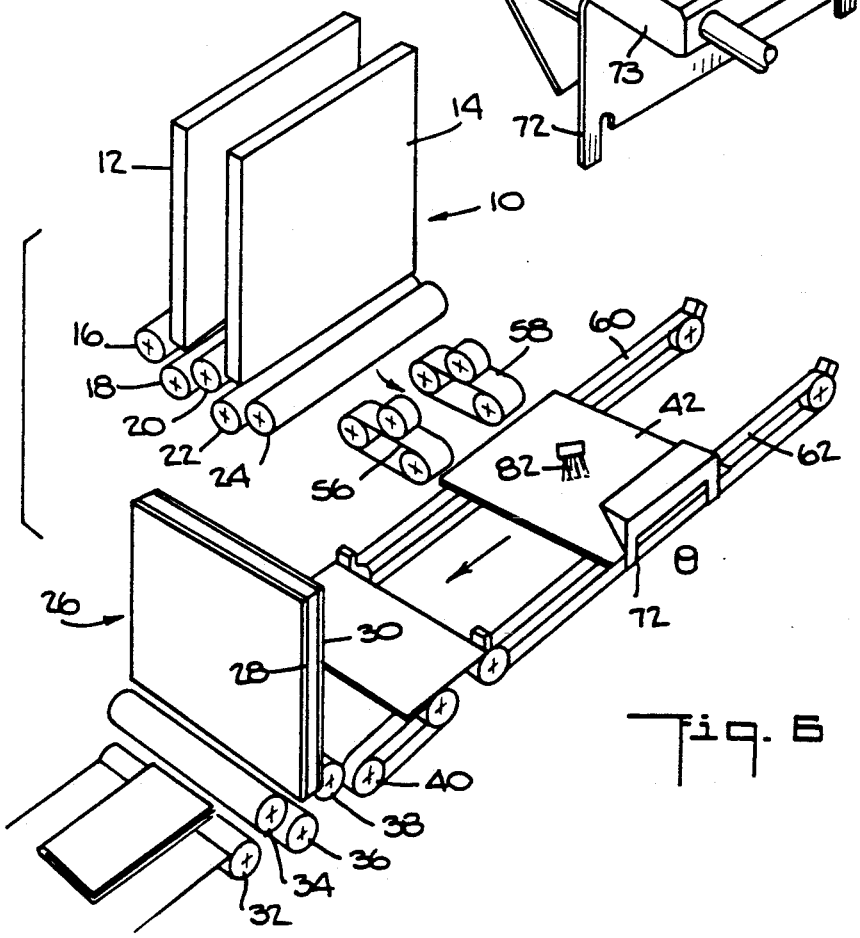
FIG. 6 is a perspective view of the two folders and transport device of the instant invention.

In describing the preferred embodiment of the instant invention, reference is made to the drawings, wherein there is seen in FIG. 6 a first buckle chute folder 10 consisting of a pair of chutes 12 and 14 and feeding-/folding rollers 16, 18, 20, 22 and 24 and a second buckle chute folder 26 oriented perpendicular to the first buckle chute folder 10. The second buckle chute folder 26 includes a pair of chutes 28 and 30 and feeding rollers 32, 34, 36, 38 and 40. Paper sheets 42 which are to be cross folded are fed from a document feeder 44 to the first feed roller 16 to be folded by the first buckle chute folder 10. The fold is imparted in a line perpendicular to the direction of travel, as is conventionally known, and the fold can be imparted midway between the ends of the sheet to effect a half fold, or some other line to effect whatever length fold is desired.

Figures 1, 7:
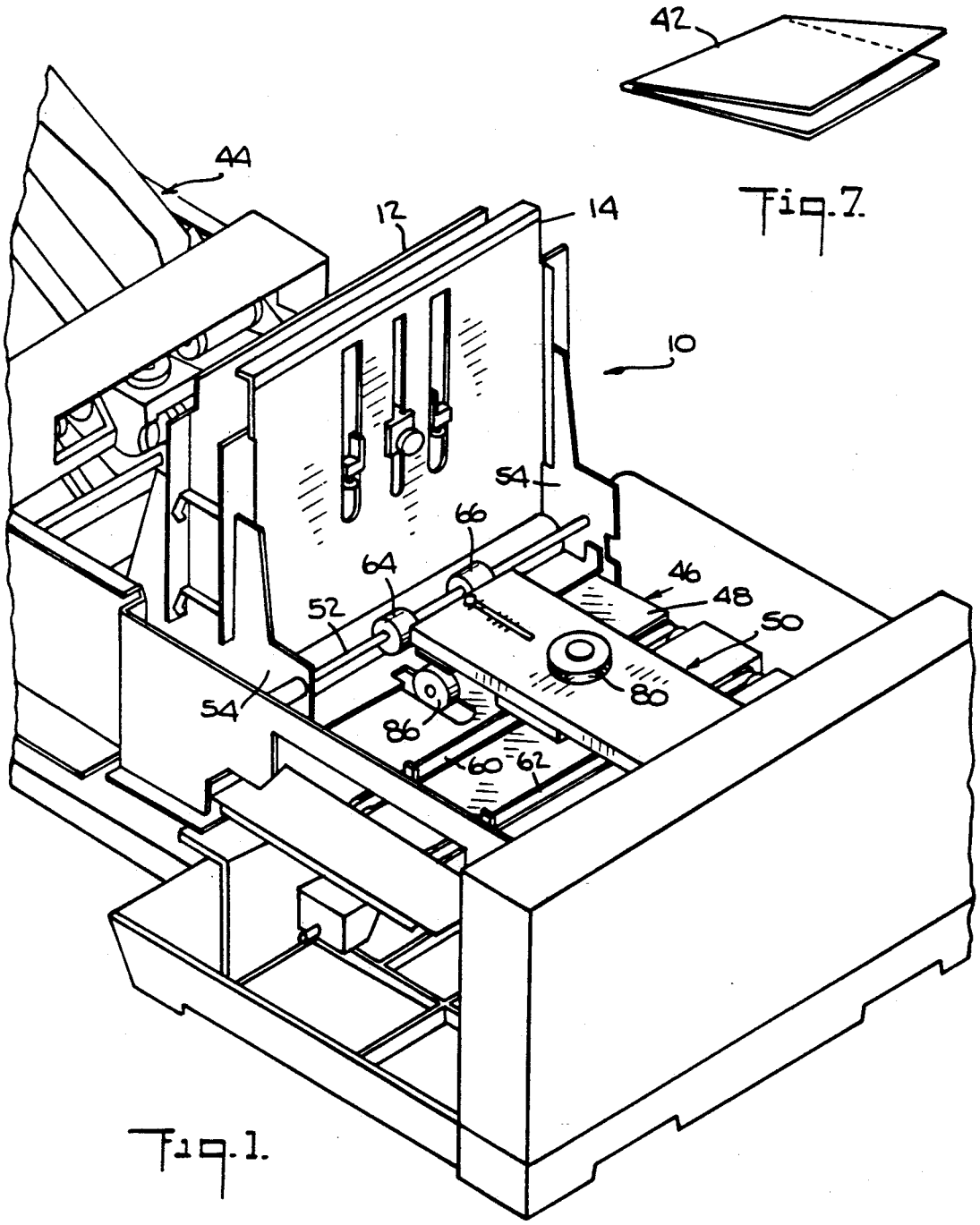
FIG. 1 is a perspective view of a transport device in accordance with the instant invention to be used with paper folders to effect cross folding of paper sheets.
FIG. 7 is a perspective view of a sheet of paper that has been cross folded, i.e. folded first in one direction and folded a second time in a direction perpendicular to the first direction.
Figure 2:
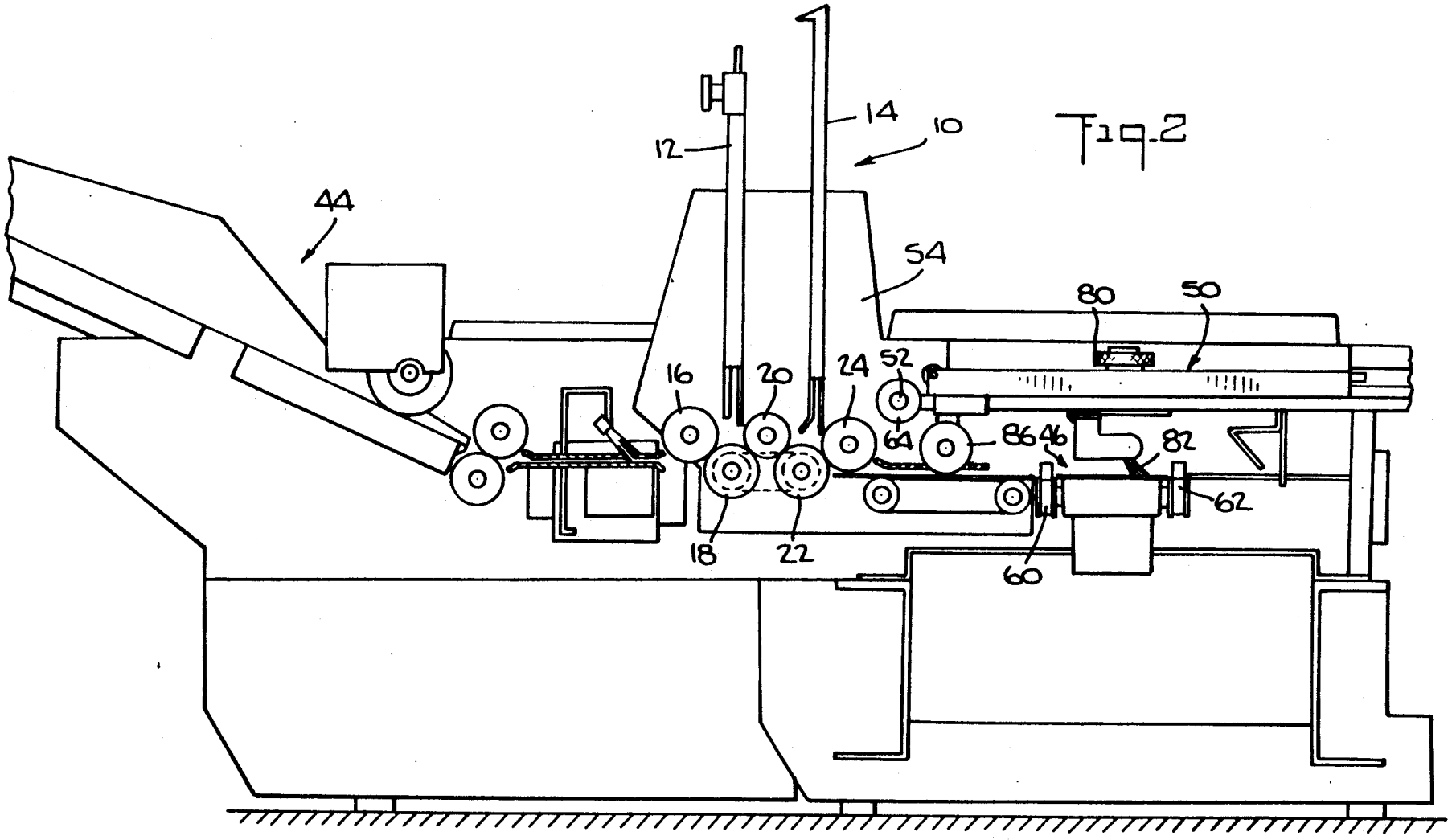
FIG. 2 is a side, elevational view of the apparatus seen in FIG. 1.
Figure 3:
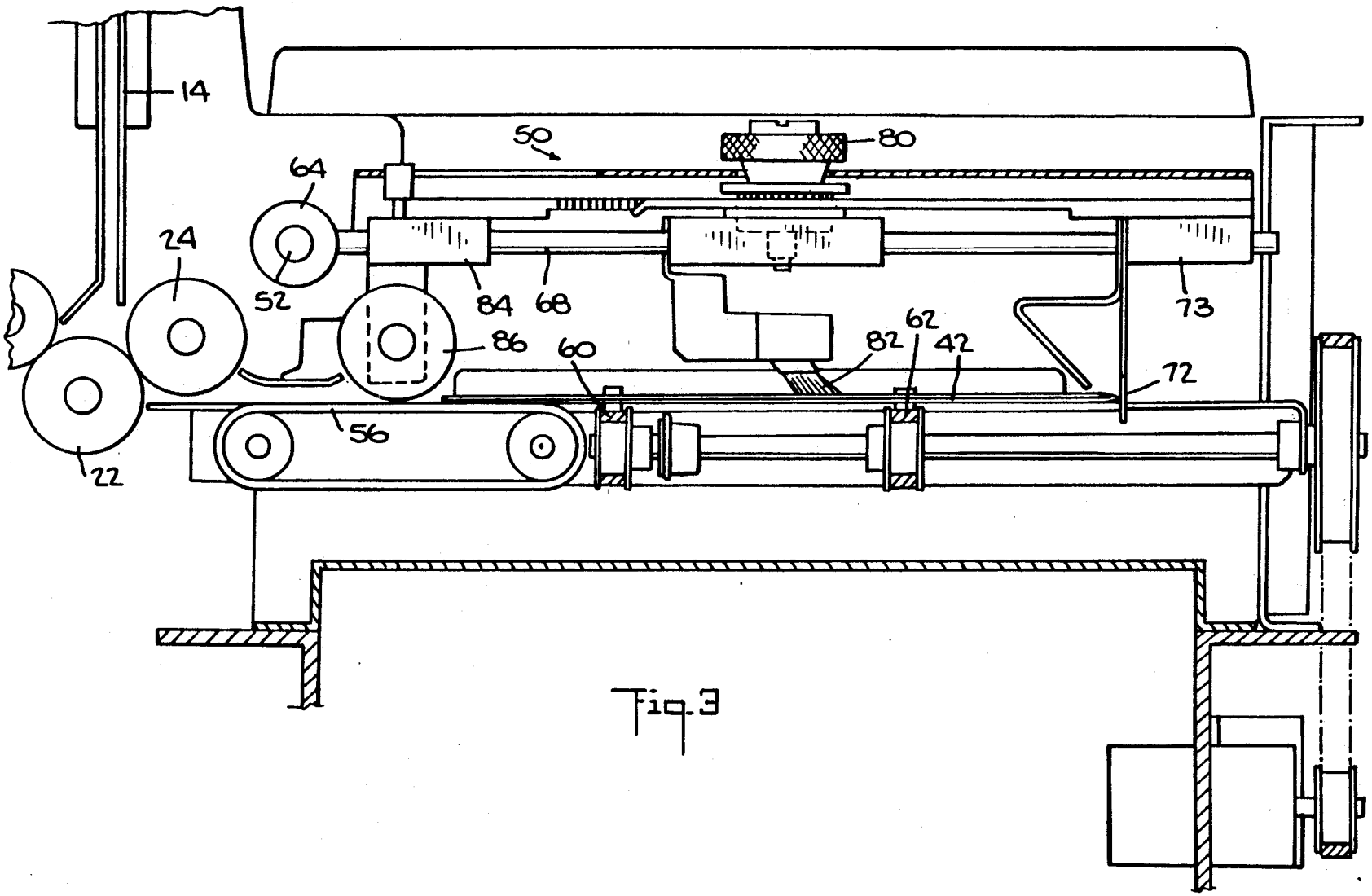
FIG. 3 is an enlarged, side elevational view of the transport device seen in FIG. 2.
Figure 5:
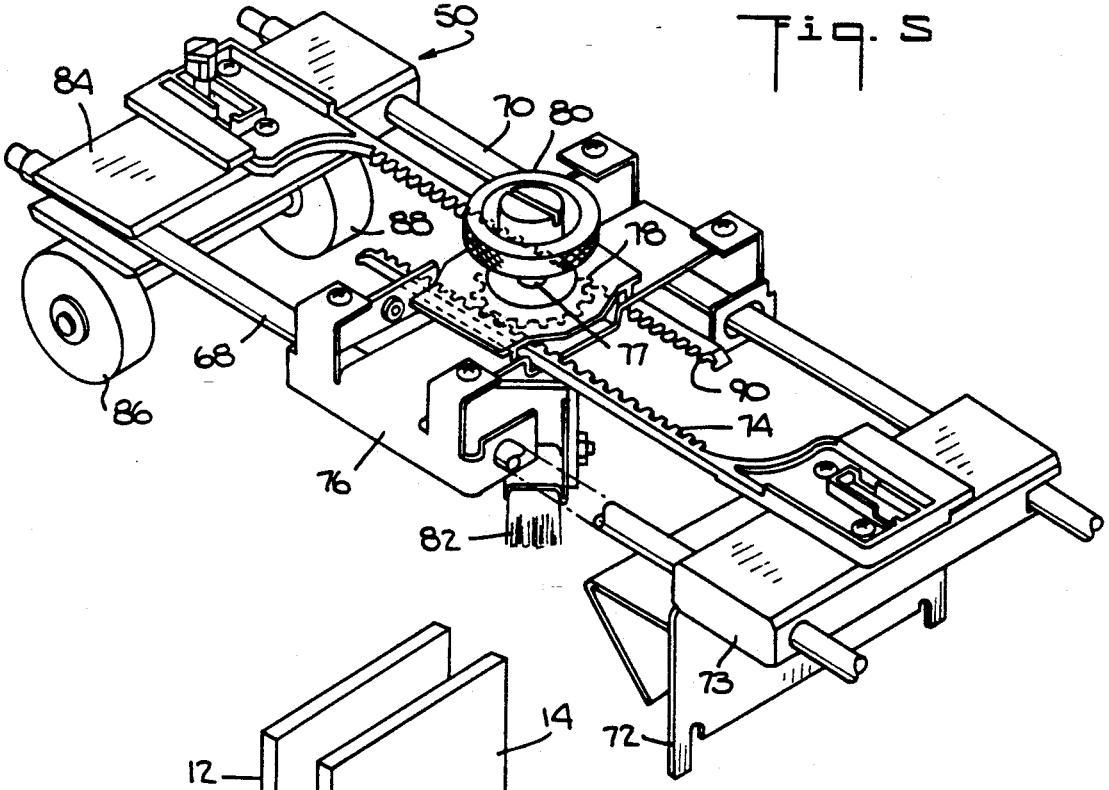
FIG. 5 is a perspective view of the braking and paper feeding components of the transport device seen in FIG. 4.

After the once folded sheet of paper 42 emerges from the first buckle chute folder 10 through the rollers 38 and 40 it enters the transport module 46, which includes a feed deck 48 and a pivotable paper stop assembly 50 (see FIG. 5) pivotably mounted on a shaft 52 (see FIG. 1) which is secured to the side frames 54 of the first buckle chute folder 10. The transport module 46 includes a first pair of flat belts 56 and 58 to feed the once folded sheet of paper 42 toward a second pair of flat belts 60 and 62 which are perpendicular to the first pair of flat belts 56 and 58. The second pair of flat belts 60 and 62 then feed the folded sheet 42 toward the second buckle chute folder 26 in direction perpendicular to the direction from which the folded sheet 42 arrived. The once folded sheet 42 which is fed from the first set of belts 56 and 58 must be precisely and accurately stopped in order to be properly aligned to be conveyed by the second pair of belts 60 and 62 so that the sheet 42 is properly aligned to be folded by the second buckle chute folder 26.

Figure 4:
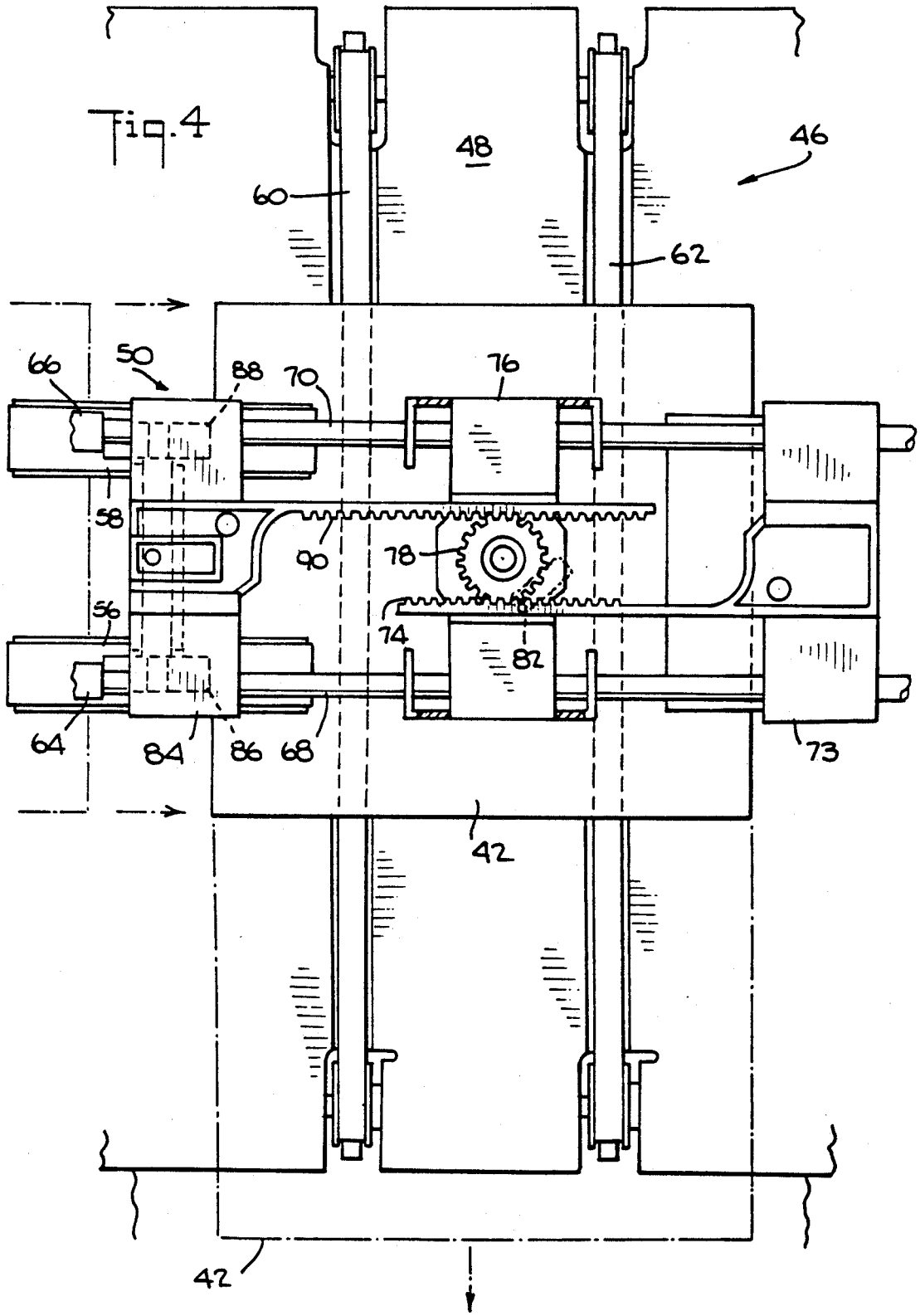
FIG. 4 is a top, plan view of the transport device seen in FIG. 3.

Situated above the transport module feed deck 48 is the pivotable paper stop assembly 50, which includes a pair of cylinders 64 and 66 (see FIG. 1) mounted on the shaft 52. A pair of cylindrical rails 68 and 70 are mounted in the cylinder 64 and 66 (see FIG. 4). A paper stopping surface 72 is secured to a slidable platform 73 mounted on the rails 68 and 70. The slidable platform is secured to one end of a rack 74.

Upstream of the stopper 72 is a stationary platform 76 secured to the rails 68 and 70 which houses a spindle 77 which supports a pinion gear 78. A knob 80 is mounted to the spindle 77 and can be rotated to rotate the pinion gear 78. A rectangular brush 82 is secured to the underside of the platform 76 for slowing the once folded paper 42 exiting the second buckle chute folder 24, and will be discussed in greater detail herinbelow.

Upstream of the platform 76 is a second, slidable platform 84 slidably mounted on the rails 68 and 70 from which platform 84 depend a pair of idler rollers 86 and 88. The platform 84 is secured to a second rack 90, which engages the pinion gear 78 as does the first rack 74.

By an operator turning the knob 80, the two racks 74 and 90 can be translated so that the paper stopping surface 72 and the idler rollers 86 and 88 can be moved closer together or further apart as the size of the paper sheet 42 warrants. Thus, it can be seen that the paper stopping surface 72 is self-centering as are the rollers 86 and 88. The brush 82 is centered with respect to the rollers 86 and 88 and the stopper 72, since it is fixedly secured to the platform 76. The brush 82 is rectangular in cross section and is oriented at a 45 degree angle to the two pairs of belts 56 and 58 and 60 and 62. The bottom of the brush 82 is located downstream of the top of the brush with respect to both directions of travel, i.e. both pairs of belts 56 and 58 and 60 and 62. The brush 82 functions to control bounceback of the paper sheet 42. The paper stopping surface 72 insures that the paper sheet 42 is properly positioned on the second pair of belts 60 and 62.

By employing the brush 82 and a self-centering stopper 72, the distance between the first pair of belts 56 and 58 and the stopper 72 is held to a minimum, i.e. no more than the substantial width of the once folded paper sheet 42. This minimum distance enables the transport module 46 to be employed in table-top inserting systems as well as console inserting systems.

While the invention has been described in conjunction with specific embodiments thereof, many alternative, modifications and variations will be apparent to those skilled in the art. It intended to embrace all such alternatives, modifications and variations that follow within the spirit and cope of the appended claims.

What is claimed is:

1. Apparatus for cross-folding paper sheets, comprising:

a first folding device for imparting a first fold to a paper sheet;

a transport module secured to said first folding device for receiving said once folded paper sheet;

and a second folding device oriented perpendicular to said first folding device and secured to said transport module, wherein said transport module includes a pivotable paper stop assembly having a pivot means linearly adjustable self-centering stopping surface to stop and align said once folded paper sheet and a brush for controlling bounceback of said once folded paper sheet.

2. The apparatus of claim 1, wherein said folding devices comprise buckle chute folders.

3. The apparatus of claim 1, wherein said transport module includes a feed deck and shaft secured to the first buckle chute folder for supporting said paper stop assembly.

4. The apparatus of claim 3, wherein said feed deck includes a first pair of flat belts and a second pair of flat belts oriented perpendicular to said first pair of flat belts.

5. The apparatus of claim 4, wherein said paper stop assembly includes a pair of rails secured to said shaft and a first slidable platform mounted on said rails, and wherein said paper stopping surface is secured to said slidable platform.

6. The apparatus of claim 5, wherein said paper stop assembly additionally includes a stationary platform upstream of said slidable platform fixedly secured to said pair of rails and a pinion gear mounted to said stationary platform.

7. The apparatus of claim 6, wherein said brush is secured to said stationary platform.

8. The apparatus of claim 7, wherein said paper stop assembly additionally comprises a second, slidable platform mounted on said pair of rails upstream of said stationary platform and a pair of idler rollers mounted to said second, slidable platform.

9. The apparatus of claim 8, wherein said paper stop assembly includes a first rack secured at one end to said first slidable, platform and a second rack secured to said second, slidable platform, and wherein both said first and second racks engage said pinion gear, whereby said racks and said first and second slidable platforms are moved closer together or further apart when said pinion gear is rotated.

* * * * *